United States Patent [19]

Houghton

[11] Patent Number: 4,924,536

[45] Date of Patent: May 15, 1990

[54] SYSTEM OF CONSERVING WATER IN A BUILDING

[76] Inventor: Connie H. Houghton, 1651 Timberwalk, Paradise, Calif. 95969

[21] Appl. No.: 361,650

[22] Filed: Jun. 5, 1989

[51] Int. Cl.[5] ..... A47K 4/00

[52] U.S. Cl. ..... 4/665; 4/415

[58] Field of Search ..... 4/665, 625, 626, 415, 4/191, 192, 661

[56] References Cited

U.S. PATENT DOCUMENTS

| | | | |
|---|---|---|---|
| 3,112,497 | 12/1963 | Call | 4/665 |
| 3,318,449 | 8/1966 | Jennings et al. | 4/665 |
| 3,594,825 | 7/1971 | Reid | 4/626 |
| 4,030,144 | 6/1977 | Aleman | 4/665 |
| 4,162,218 | 7/1979 | McCormick | 4/665 |
| 4,349,436 | 9/1982 | Kaump | 4/665 |
| 4,554,688 | 11/1985 | Puccerella | 4/191 |
| 4,563,780 | 1/1986 | Pollack | 4/192 |

FOREIGN PATENT DOCUMENTS

| | | | |
|---|---|---|---|
| 3722240 | 3/1988 | Fed. Rep. of Germany | 4/665 |

*Primary Examiner*—Henry J. Recla
*Assistant Examiner*—Keith Kupferschmid

[57] ABSTRACT

A system of conserving water using non-electrically operated, readily available plumbing equipment. The water to be saved with the system is water once heated which has cooled due to heat loss in a hot water line. This normally wasted cold water in the hot water line is often directed down the drain prior to dispensing of the hot water from a fixture. The system is adapted to divert the normally wasted cold water in the hot water line to a remotely positioned storage tank. The diverting process begins upon manual activation of a by-pass valve positioned slightly upstream of the hot water valve of a typical hot water dispensing fixture. The cold water to be saved is diverted by the manual by-pass valve through by-pass piping leading into the storage tank. The storage tank is also plumbed with piping to the water input piping of each toilet tank reservoir of the building. The reservoir tanks of any of the toilets connected to the by-pass system are filled with the water which was previously stored in the storage tank.

8 Claims, 2 Drawing Sheets

SYSTEM OF CONSERVING WATER IN A BUILDING

BACKGROUND OF THE INVENTION

1. Field of the Invention

This invention relates to systems useful for saving fresh water in a building. The system diverts normally wasted fresh water into a storage tank for saving, and utilizes the saved water for filling the reservoir tanks of toilets in the building.

2. Description of the Prior Art

Hot and cold running water are common in buildings today. Normally hot water is piped in one line, and cold water is piped in a separate line to water dispensing fixtures throughout the building. Although some hot water lines are insulated, heat from the hot water within the line will inevitably be lost through the piping whether the line is insulated or not. The time will vary, but whenever hot water sits in a line for a period of time, the water becomes cold. Few people like to wash their hands or take a shower in cold water while waiting for the hot water to flush the cold water out of the line prior to the dispensing of the hot water. When the cold water is completely flushed from the hot water line, it is quickly followed by hot water which could catch a person off guard causing scalding. Most people practice the habit of letting the hot water faucet run until the cold water in the line is flushed out prior to using water from the hot water line. During this line flushing process, the unused, flushed cold water is normally directed down the drain into the sewer.

Homes, mobile homes and other building structures normally use toilets having reservoir tanks attached thereto. The toilet reservoir tanks are adapted to supply a large volume of water in a short period of time for flushing. When the water level of a toilet reservoir is low, such as after a flushing operation, the water is automatically replenished by a conventional water level float valve in the reservoir, drawing water from the pressured cold water line of the building. The amount of water used in toilet flushing is substantial where conservation of water is important.

A past art patent search was conducted to examine systems adapted to save normally wasted fresh water and utilize the saved water for exclusive use in toilet reservoirs. Although no systems were found which disclosed or anticipated the immediate invention, the following patents are considered somewhat relevant to my system:

The patent issued to Pollack on Jan. 14, 1986, U.S. Pat. No. 4,563,780, shows an automated computer controlled bathroom which can be programed to control the amount of water flow, and the temperature and period of time the water is dispensed. A user can program the computer to automatically fill the bath tub at his convenience and at the temperature of his choice. Water standing in the hot water pipe which is not of the correct temperature is automatically directed down the drain until the incoming hot water reaches the desired temperature for dispensing. This system is not designed to save water and actually wastes water by directing it down the drain.

On Nov. 26, 1985, Thomas J. Puccerella was granted U.S. Pat. No. 4,554,688 for a water saving system which redirects cold standing water in hot water pipes back to the hot water heater for reheating. This system requires an electric power source, a solenoid valve, temperature sensors and a water circulation pump. Although the Puccerella invention does conserve water, the complex design of the system appears as if it would be costly for both installation and maintenance of the electrical equipment utilized.

Unfortunately many older buildings have lead pipes or copper pipes soldered with a lead based solder. The lead in the piping often partially dissolves into the water. The dissolving of lead occurs more readily in hot water than in cold water. The Puccerella recirculating system appears as if the hot water cycled through the hot water lines and returned to the water heater could eventually lead to a high concentration of lead in the water. This hot water having a high concentration of lead could unknowingly be used for cooking water or hot beverages much to the detriment of the consumer. Greater exposure of the water to lead in plumbing usually results in a higher concentration of lead in the water. Recirculating systems such as the Puccerella system are often associated with high levels of lead in drinking and cooking water due to the increased exposure of the water to lead in pipes.

SUMMARY OF THE INVENTION

In practicing my invention I utilize readily available, non-electrically operated plumbing equipment to conserve water in a building. The water to be saved with my system is once heated water in a hot water line which has become cold due to heat loss. This water to be saved is the normally wasted cold water flushed from the hot water line and directed down the drain prior to the dispensing of hot water. My system diverts this normally wasted water to a remotely positioned by-pass water storage or holding tank. The diverting process begins upon manual activation of a by-pass valve positioned slightly upstream of a standard manually operated hot water faucet valve of a conventional water dispensing fixture. Normally, a manual by-pass valve would be positioned adjacent each hot water dispensing fixture. For the purpose of this disclosure the term "water dispensing fixture" applies to water dispensing devices such as sinks, showers, bathtubs and the like. The cold water to be saved is diverted by the manual by-pass valve through by-pass piping leading into the by-pass water storage tank. The storage tank and by-pass piping are also plumbed with water input piping to each toilet tank reservoir of the building. The saved or by-passed water is not put back into the domestic water supply of the building eliminating the risk of the water being further exposed to possible contaminates in the pipes and then being consumed by humans. The reservoir tank of any of the toilets connected to the by-pass system is filed with the water which was previously stored in the by-pass water storage tank.

Two types of by-pass water storage tanks have been found to function suitably well with my system. One type of suitable storage tank is a gas or air pressure tank, preferably of the captive-air bladder type. The second type of suitable storage tank is a non-pressurized tank. The non-pressurized storage tank utilizes gravity flow to fill the toilet reservoirs and consequently must be elevated above any point of dispensing.

The volume of water flushed through my by-pass valve will on occasion be insufficient to meet the normal requirements of toilet flushing in a building. In order to supplement the volume of water put into the by-pass storage tank through the by-pass valve, the storage tank is also attached to the pressured domestic water line of the building.

Therefore, a primary object of my invention is to conserve fresh water in a building.

Another object of my invention is to conserve water in a building using a system which uses only readily available plumbing components.

A further object of the invention is to conserve water in a building using a system which saves water in a hot water line which was once heated and has become cold due to heat loss.

A still further object of my invention is to conserve water in a building using a system which does not add any additional electrical equipment to conventional plumbing.

An even further object of my invention is to conserve water in a building using a system which does not additionally expose water intended for human consumption to possibly contaminated piping.

Further objects and advantages of my system will be realized by reading the remainder of the specification.

BEST MODE FOR CARRYING OUT THE INVENTION

Figure 1:
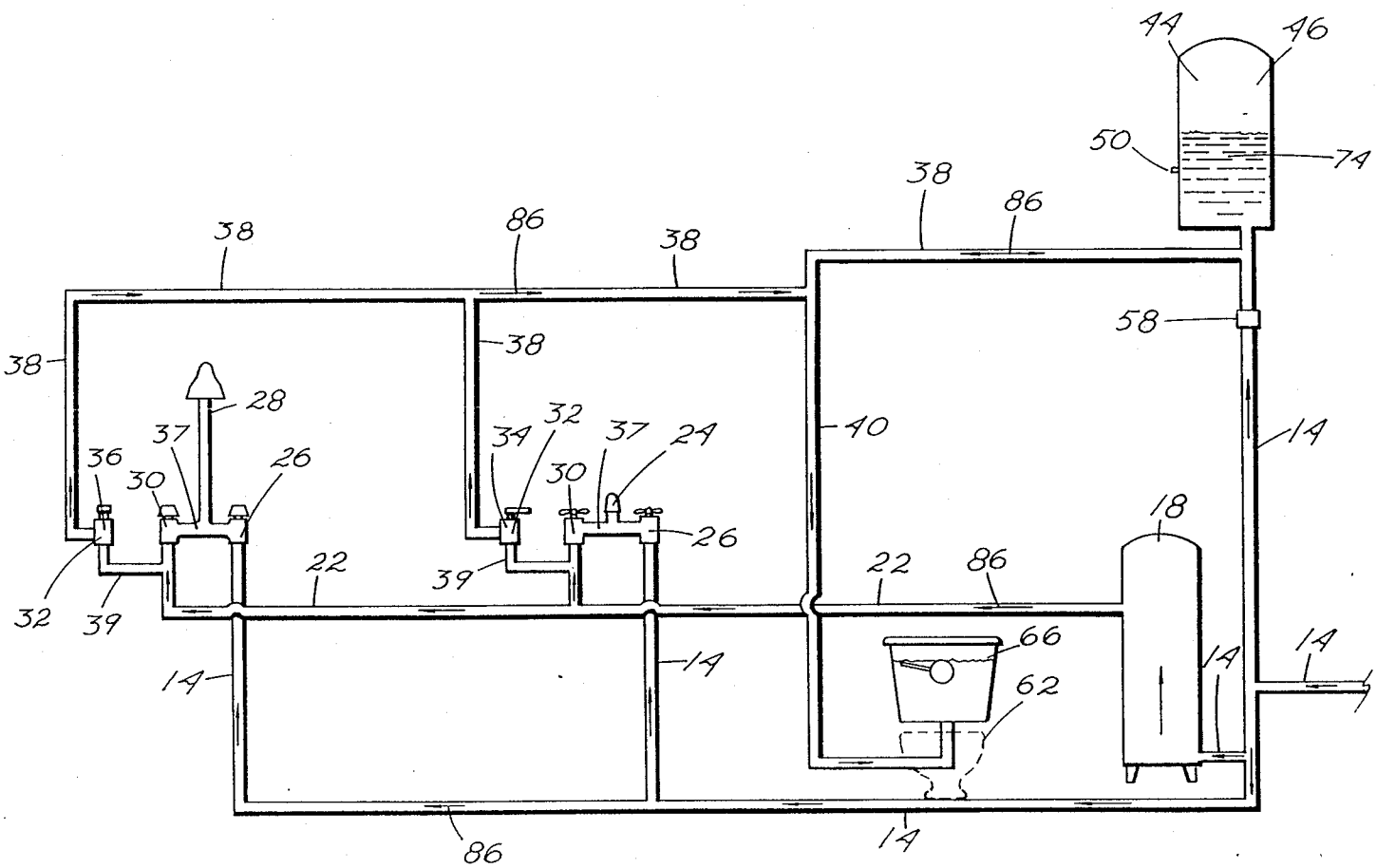
FIG. 1 is a schematic representation of the components and piping of a typical by-pass water saving system arranged utilizing the principles of my invention herein disclosed. Shown in the drawing is a pressured domestic water line feeding the system, a water heater, a toilet, sink fixture, shower fixture, by-bass valves adjacent each of the water dispensing fixture, by-pass piping, a pressure type by-pass water storage tank, and hot and cold water lines.

The following detailed description of my water saving system can best be understood by referencing numbered components described below with like numbered components shown in drawing FIGS. 1 and 2. The drawings are illustrative of a system using both a shower arrangement 28 and a sink arrangement 24, although only one hot water dispensing arrangement is necessary for the system to function. Water flow directional arrows 86 are provided in the drawings to indicate the normal direction of water flow in the piping of the system. My system of saving water includes at least one toilet 62 with toilet reservoir tank 66, and at least one hot water dispensing fixture such as sink 24 or shower 28. The system also includes some type of water heater 18 for heating water.

Connected to the water input opening of water heater 18 is a pressured cold water supply line 14 to supply water under pressure into the water heater 18. Connected to the water output opening of water heater 18 is hot water line 22. From water heater 18, hot water line 22 conducts hot water to one side of a hot water faucet valve 30 adjacent each hot water dispensing fixture 24 and 28. Hot water valves 30 are conventional, being manually operable water control valves having a first and second opening or an input and output opening. The opposite sides of each valve 30 are connected with some type of water conductive tubing 37 which connects the output side of the valve 30 to the water dispensing nozzle of the fixture. Often the water conductive tubing 37 is built into the water dispensing fixture as a factory installed part thereof, which is especially true of sink fixtures. Also shown in drawing FIG. 1 is pressured water supply line 14 attached to cold water valves 26 at sink 24 and shower 28.

Designated as number 39 is a short length of water piping connected at one end to hot water line 22, and at the opposite end of pipe 39 to a manually operable water by-pass control valve 32, the number referring to by-pass valves in general. Water piping 39 should be connected to hot water line 22 upstream of hot water valve 30, between water heater 18 and valve 30. Water piping 39 should also be connected as close to hot water valve 30 as is possible. Water piping 39 conducts water from hot water line 22 to one side of the by-pass valve 32. Shown at sink 24 is water by-pass valve 34 which is a manually openable and manually closeable valve. Shown at shower 28 is a water by-pass valve 36 being manually openable and automatically closeable. By-pass valve 36 is a readily available water control valve which contains internal mechanics causing the valve to automatically close after a set period of time. The setting of the closing time is adjustable. Other self-closing valves are also available which measure the volume of water passed through the valve to determine when to close. Either type of automatic closing valve will work in the system. Either automatically or manually closing by-pass valves will work in the system and will be explained further, later in the disclosure. The by-pass valve 32 should preferably be placed within arms reach of a water dispensing fixture.

Connected to the opposite side of by-pass valve 32 from that of piping 39 is by-pass piping 38. By-pass piping 38 extends from by-pass valve 32 to a by-pass water storage tank designated in general as 44. By-pass piping 38 is adapted to conduct water passed through by-pass valve 32 into the by-pass water storage tank 44. Connected at one end to by-pass piping 38 between by-pass valve 32 and storage tank 44 is toilet reservoir piping 40. The opposite end of toilet reservoir piping 40 is connected to the water input line of the toilet reservoir tank 66 of toilet 62. Toilet reservoir tank 66 is of conventional structuring having a float control valve regulating the amount of water which can enter the tank 66 through the tank input line. By-pass valve 32, by-pass piping 38, by-pass water storage tank 44 and toilet reservoir piping 40 form a water by-pass system. The bypass system provides an alternative water flow path from that formed through hot water valve 30 to the dispensing nozzle of shower 28 or sink 24.

The purpose of my water saving system is to save water which is very often directed down the drain completely unused. This water to be saved is hot water which has set in hot water line 22 for a sufficient period of time to become cold due to heat loss. In order to avoid having to use cold water from the hot water line 22 when hot water is actually desired, and to avoid wasting the cold water in hot water line 22 by directing it down the drain, a user of my system would simply first manually activate by-pass valve 32 to open the valve 32. Cold water in hot water line 22 would flow through piping 39, through by-pass valve 32 and into by-pass piping 38. By-pass piping 38 would deliver the water into by-pass water storage tank 44. At the same time the by-pass water would fill toilet reservoir piping 40 and the toilet reservoir tank 66 if the float valve in the toilet tank was by chance in the open position demanding water.

The amount of cold water needing to be flushed from hot water line 22 will vary depending on a number of factors such as length of the line 22 from hot water heater 18, and the amount of time the hot water has set in the line 22 for example. Once the water saving system has been installed in a building, in a bathroom with a sink for example, the user quickly learns the approximate period of time to allow the by-pass valve 32 to remain open. This flushing time period is normally between ten seconds to one minute, but can vary widely from system to system. Often a user can sense the temperature of the water through the handle of the by-pass valve 32 to determine when to stop by-passing the water. By-pass valve 32 should be left open only long enough to flush the cold water out of hot water line 22. After the cold water has been flushed from the hot water line 22, the user manually closes the by-pass valve if the system is using a manually closeable valve 34. If the system is equipped with an automatic closing by-pass valve 36, the valve 36 would close automatically at a preadjusted interval subsequent to the flushing of the cold water from hot water line 22. Once the by-pass operation is completed, the user can open the hot water valve 30 on his sink 24 or shower 28. If water piping 39 was connected to hot water line very close to valve 30 during installation of the system, hot water should be dispensed almost immediately upon opening the hot water valve 30. By utilizing my system, no water has been wasted and the user did not have to wash in cold water and then possibly get scalded when the hot water finally arrived. The by-pass water 74 in by-pass piping 38 and stored in by-pass water storage tank 44 is available for use in toilet reservoir tank 66 when needed.

Two types of by-pass water storage tanks 44 have been found to function suitably well with my water saving system. One type of suitable storage tank is a gas or air pressure tank, preferably of the captive-air bladder type pressure tank 46. The second type of suitable by-pass water storage tank is a non-pressured tank 70 shown in FIG. 2. The non-pressured storage tank 70 utilizes gravity flow to fill the toilet reservoirs 66 and consequently must be elevated well above any point of dispensing. By-pass water pressure tank 46 can be placed at a variety of elevations around the building structure since the by-passed water 74 is put into the pressure tank 46 under pressure, the water is stored under pressure, and therefore is delivered to the toilet reservoir tank 66 under pressure.

The volume of water flushed through the by-pass valve may periodically be insufficient to meet the normal volume requirements of toilet flushing in a building. In order to supplement the volume of water put into the by-pass water storage tank 44 through the by-pass valve 32, the by-pass system is also attached to the pressured cold water supply line 14 for supplemental water. A regulating means of some kind to regulate the amount of water allowed from water supply line 14 as supplemental water must be used. Without some type of regulating means on pressured water supply line 14, there would be no capacity in the tank 44 reserved for the storing of by-passed water 74.

For reserving capacity in pressure tank 46 for by-pass water, a conventional adjustable water pressure regulator valve 58 is installed in-line in pressured water supply line 14 between line 14 and the water by-pass system. The placement of pressure regulator valve 58 must be in a location of the piping where the regulator 58 exclusively regulates water pressure and flow between pressured water supply line 14 and the water by-pass system. The pressure regulator valve 58 cannot be placed in pressured water supply line 14 where it would regulate the pressure of water in the cold water sides of water dispensing fixtures or water heater 18. Since it is the water pressure put into the water heater 18 which pressures water movement in hot water line 22 for flushing cold water into the by-pass system, the by-pass water supplementing system would not function with the pressure regulator valve 58 placed incorrectly.

The operational principles of the pressure regulator valve 58 are based on pressure differentials between an input and output side of the valve 58. In my system of saving water, supplementation of by-pass water storage tank 46 works in combination with pressure regulator valve 58 as follows: Assuming pressured water supply line contains water under 50 lbs. pressure. Upon opening a by-pass valve 32 for a sufficient length of time or number of times to completely fill pressure tank 46, the water in tank 46, toilet reservoir piping 40, and the remainder of the by-pass system would also be under 50 lbs. pressure. Pressure regulating valve 58 would normally be set to open allowing water to flow out the output side of the valve when the water pressure on the output side of valve 58 reached 18 to 20 lbs. Above 20 lbs. pressure, valve 58 remains closed. With 50 lbs. pressure in the water by-pass system, a person could flush the toilet a number of times before the pressure in the by-pass system was reduced to 20 lbs. or less, assuming the by-pass valve had not been opened replenishing the water 74 in by-pass water storage tank 46. After a number of toilet flushes, the pressure in the by-pass system would be reduced to approximately 18 lbs. At this low pressure, pressure regulating valve 58 would open allowing water to flow into the by-pass system bringing the water pressure back up to about 20 lbs. before the valve 58 closed automatically. With 20 lbs. pressure in the by-pass system, and regulator valve 58 closed, there is still sufficient pressure and water to fill a toilet reservoir tank 66 with water, and there is still unfilled capacity in storage tank 46 to allow by-passing of water into the system. If by chance sufficient by-passing of cold water occurred to completely fill storage tank 46 and additional water by-passing was desired with the tank 46 full, water could not be by-passed through the by-pass system until the volume of water in the storage tank 46 was reduced by flushing toilet 62. However, this situation with a properly sized tank 46 would normally never arise, and if it did, no damage would occur. Pressure tank 46 in drawing FIG. 1 is shown having an air charging valve 50 which is common on pressure tanks for maintaining proper amounts of a compressible gas in the top of the tank 46 and will be understood by those skilled in the art.

Figure 2:
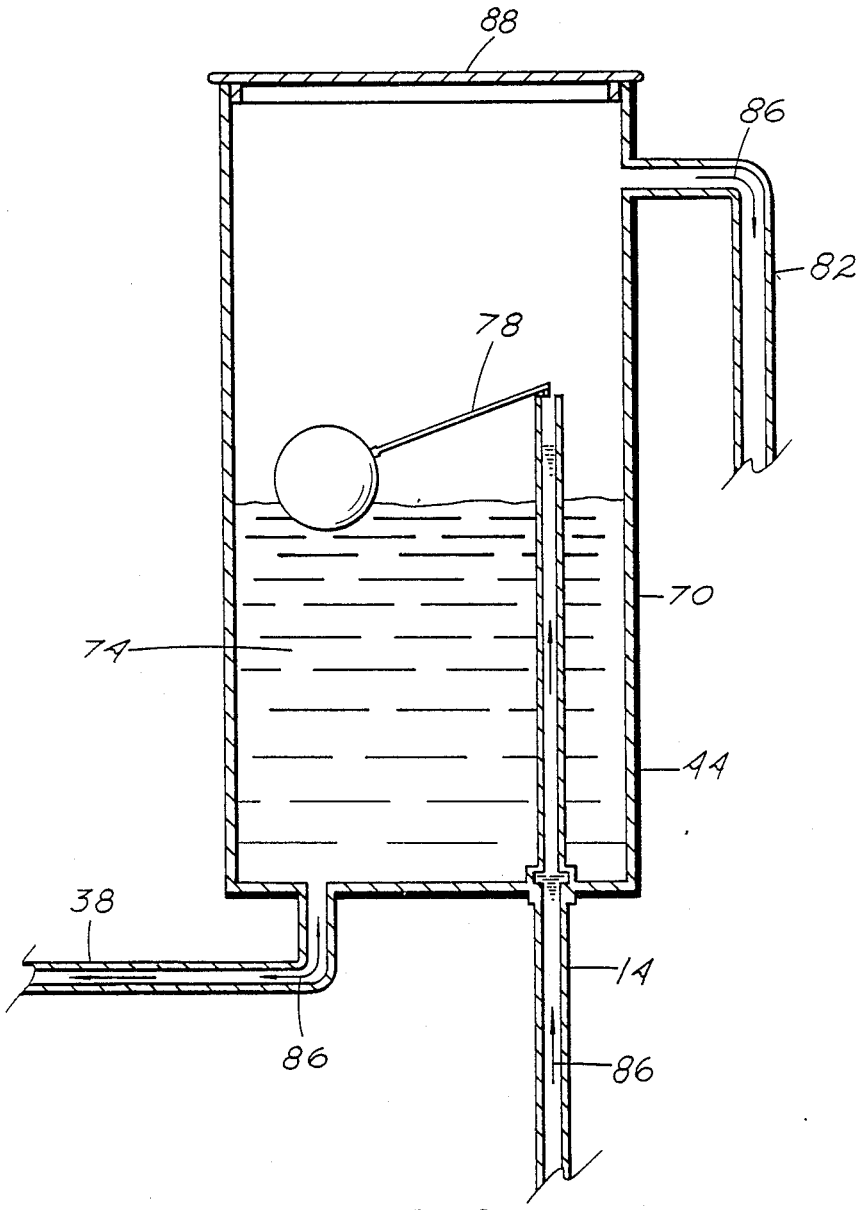
FIG. 2 is a sectional view of a non-pressured by-pass water storage tank. The storage tank is illustrated having a water level float valve on a pressured water input line used for supplementing the volume of water in the tank.

By-pass water storage tank 70 shown in FIG. 2 is a non-pressured tank. Since tank 70 has an unsealed tank cover 88, it can not be pressurized to equal the pressure passing through an open by-pass valve 32 in order to stop the flow of by-pass water as is the case of storage tank 46. The scenario of the full tank 46 above is slightly different from that of storage tank 70. With storage tank 70, when the tank 70 becomes full, the water is allowed to flow out an overflow line 82 connected at the upper side of the tank and terminating in the sewer or a flower garden. Again, this should never happen with a properly sized storage tank 70 under normal conditions.

For supplementing water while still reserving capacity in by-pass water storage tank 70 as shown in FIG. 2, a water level float valve 78 is illustrated used in the tank 70. With storage tank 70, pressure regulating valve 58 is not used. Tank 70 in FIG. 2 is shown having by-pass piping 38 entering in a separate location from that of pressure water supply line 14. Supplemental water entering tank 70 through pressured water supply line 14 is regulated by float valve 70. The operational principles of water level float valve 78 are well known being the same as those used in most toilet reservoir tanks today. FIG. 2 is illustrative of float valve 78 in the closed position, the tank 70 partially filled, and tank capacity reserved for cold water by-passing through the by-pass system.

I have shown and described a by-pass valve 32 adjacent each water dispensing fixture 24 and 28, however it should be noted that in a bathroom or other arrangement where two hot water dispensing fixtures are in close proximity to each other, a single by-pass valve 32 can be placed centrally between the fixtures for by-passing the hot water lines 22 of both fixtures. The single by-pass valve 32 when opened would flush the cold water upstream of both hot water valves 32 of both fixture attached to hot water line 22 leaving only a short distance of line 22 containing cold water upstream of either hot water valve 30 of each hot water dispensing fixture. It should also be noted that a plurality of toilets 62 each having a toilet reservoir tank 66, and any number of hot water dispensing fixtures may be connected to the water by-pass system utilizing a single by-pass water storage tank 44.

Although I have shown my invention by way of illustrations and clearly described the operational principles of my system, this was for the purpose of example only. I do not wish to have the scope of my patent protection limited by the very specific examples disclosed in the specifications since those skilled in the art will recognize upon reading this disclosure that modifications may be made to my water saving system without departing from the scope of the appended claims.

What I claim as my invention is:

1. A system of saving water in a building having at least one toilet with toilet reservoir tank, and at least one hot water dispensing fixture, said system being arranged to save normally wasted cold water flushed from a hot water line prior to dispensing of hot water, said system comprising in combination;

a water heater adapted to heat said water;

a pressured water supply line containing said water;

said pressured water supply line attached to an input opening of said water heater adapted to supply said water into said water heater;

said hot water line connected at one end thereof to a hot water output opening of said water heater, said hot water line being further connected to a first side of a manually operable faucet valve positioned adjacent said hot water dispensing fixture, said hot water line adapted to supply said water from said water heater to said faucet valve;

water conductive means between a second side of said faucet valve and said hot water dispensing fixture adapted to direct said water from said faucet valve to said hot water dispensing fixture for dispensing;

a manually operable water by-pass valve connected at a first side thereof to water piping, said water piping being further connected to said hot water line upstream of said faucet valve, said connected water piping adapted to direct said water in said hot water line to said by-pass valve;

by-pass piping connected at a first end thereof to a second side of said by-pass valve, a second end of said by-pass piping connected to a by-pass water storage tank;

said by-pass valve adapted to control water flow between said connected water piping and said by-pass piping;

said by-pass valve with said connected water piping and said connected by-pass piping adapted to provide a flow path for said water in said hot water line with said flow path being an alternative flow path to that formed by said faucet valve and said hot water dispensing fixture;

said water in said hot water line capable of being by-passed by manually opening said by-pass valve whereby said cold water is directed from said hot water line into said by-pass piping and said by-pass water storage tank;

said water by-passing capable of being terminated upon closing of said open by-pass valve, said closing of said open by-pass valve being normally subsequent to said cold water in said hot water line being flushed into said by-pass piping;

toilet reservoir piping adapted to conduct said by-pass water to said toilet reservoir tank whereat a water level control valve of said toilet reservoir tank regulates input of said by-pass water into said toilet reservoir tank;

said by-pass valve, said by-pass piping, said toilet reservoir piping, and said by-pass water storage tank forming a water by-pass system;

said pressured water supply line being further connected to said water by-pass system downstream of said by-pass valve, said connected water supply line adapted to automatically supply supplemental water to said by-pass water storage tank in order to maintain said by-pass water storage tank in a partially filled state;

means adapted to limit said supplied supplemental water to said by-pass water storage tank to less than total storage capacity of said by-pass storage tank with remaining capacity of said storage tank being reserved for filling with said by-pass water.

2. The system of claim 1 wherein said cold water in said hot water line is water having been once heated by said water heater which has cooled due to heat loss through said hot water line.

3. The system of claim 1 wherein said by-pass valve is manually operable for both said closing and said opening of said valve.

4. The system of claim 1 wherein said by-pass valve is manually operable for said opening and automatic for said closing of said valve.

5. The system of claim 1 wherein said by-pass storage tank is a non-pressured tank elevated above said toilet reservoir tank adapted for gravity feeding said water of said by-pass system into said toilet reservoir tank.

6. The system of claim 1 wherein said by-pass storage tank is a pressure tank adapted to store said water of said by-pass system under pressure.

7. The system of claim 1 wherein said means adapted to limit said supplied supplemental water is a water pressure regulator valve positioned between said by-pass system and said pressured water supply line, said water pressure regulator valve being placed in said pressured water supply line and adapted to exclusively regulate water pressure and flow between said pressured water supply line and said water by-pass system.

8. The system of claim 1 wherein said means adapted to limit said supplied supplemental water is a water level float control valve connected to said pressure water supply line adapted to sense a predetermined water level in said by-pass storage tank, said float control valve further adapted for opening said pressured water supply line upon sensing low water in said by-pass water storage tank to allow supplementing said water in said storage tank when necessary, and closing said pressured water line when said by-pass water storage tank is partially full.

* * * * *